US005086714A

United States Patent [19]

Hladun

[11] Patent Number: 5,086,714

[45] Date of Patent: Feb. 11, 1992

[54] VIBRATORY HEARTH

[76] Inventor: Kenneth W. Hladun, 1137 N. Woodbine Ave., Narberth, Pa. 19072

[21] Appl. No.: 509,085

[22] Filed: Apr. 16, 1990

[51] Int. Cl.[5] ..... F23H 7/00; F23H 13/02; F23J 1/02; F23G 5/12

[52] U.S. Cl. ..... 110/281; 110/165 A; 110/165 R; 110/258; 110/171

[58] Field of Search ..... 110/234, 255, 257, 259, 110/266, 278, 283, 315, 316, 166, 165 R, 165 A, 171, 258, 281

[56] References Cited

U.S. PATENT DOCUMENTS

| | | | |
|---|---|---|---|
| 3,592,150 | 7/1971 | Lanyon et al. | 110/258 X |
| 3,713,403 | 1/1973 | Maille | 110/165 R X |
| 3,949,685 | 4/1976 | Replogle | 110/165 A |
| 4,286,527 | 9/1981 | Robinson et al. | 110/171 X |
| 4,491,077 | 1/1985 | Petty et al. | 110/165 R X |
| 4,586,442 | 5/1986 | Caughey et al. | 110/258 X |
| 4,724,779 | 2/1988 | White et al. | 110/281 |

*Primary Examiner*—Henry A. Bennett
*Assistant Examiner*—Christopher B. Kilner
*Attorney, Agent, or Firm*—Norman E. Lehrer

[57] ABSTRACT

A hearth for use in a thermal processor or incinerator includes a substantially planar grate which is inclined upwardly and which is vibrated in such a way that material deposited on the input end of the grate moves upwardly toward the output end thereof. A dam in the form of a raised wall at the beginning of the grate prevents liquids and other materials from spilling off. A plurality of openings passing through the grate allow combustion air to pass therethrough from below. Located beneath the hearth is an ash bin in the form of a plenum which catches and accumulates ashes that fall through the air openings in the grate. Air forced into the plenum is used to clean out the ash by opening an outlet port at the end thereof.

13 Claims, 2 Drawing Sheets

VIBRATORY HEARTH

BACKGROUND OF THE INVENTION

The present invention is directed toward a vibratory hearth and, more particularly, toward such a hearth which is used in a thermal processor or incinerator for treating or disposing of waste materials.

Non-hazardous and hazardous waste materials may consist of solids and/or liquids and are of wide and various compositions. With the proper retention and placement of materials in a thermal processor or incinerator, such materials can be processed safely. However, if the material bypasses the complete process due to either physical state or physical shape, the material is not safely or completely processed.

Devices have been proposed in the past for safely treating or incinerating waste materials. U.S. Pat. No. 3,592,150, for example, is directed toward a method and device of incinerating viscous liquids and includes an inclined hearth onto which the liquid is introduced. However, the hearth is stationary and accordingly a rake must be constantly utilized to move and remove the ash.

A significant advance was taught in U.S. Pat. Nos. 3,791,316 and 3,841,242 wherein air is introduced from beneath the hearth and the hearth is inclined downwardly and is also vibrated. While these patents describe systems that are useful for burning solid materials, they are not particularly useful for liquids.

The stirring action of a rotary kiln has made it popular in waste incineration applications. The rolling action exposes the bottom of the unburned waste material to the combustion air. U.S. Pat. No. 4,793,269 has further improved on this technology by proposing a rotary kiln wherein underfire combustion air is introduced into the kiln.

In forward-inclined hearths or kilns a liquid can transverse the treatment area much quicker than the solid components. Also, a shape that can easily roll will traverse the treatment area much quicker than flat objects. In either of these cases, when treatment time at a particular temperature is important, bypassing the treatment area can result in ineffective treatment. For applications where the feed stream is variable and/or mixed, none of the hearths of the prior art can satisfactorily deal with the same. Nor has the prior art satisfactorily dealt with the removal or accumulation of ash that falls down through air holes in the grate.

SUMMARY OF THE INVENTION

The present invention is designed to overcome all of the deficiencies of the prior art stated above and is capable of incinerating or otherwise treating both solids and liquids and mixtures thereof. The hearth of the present invention includes a substantially planar grate which is inclined upwardly and which is vibrated in such a way that material deposited on the input end of the grate moves upwardly toward the output end thereof. A dam in the form of a raised wall at the beginning of the grate prevents liquids and other materials from spilling off. A plurality of openings passing through the grate allow combustion air to pass therethrough from below. Located beneath the hearth is an ash bin in the form of a plenum which catches ashes that fall through the air openings in the grate. Air forced into the plenum is used to clean out the ash through an outlet port at the end thereof.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
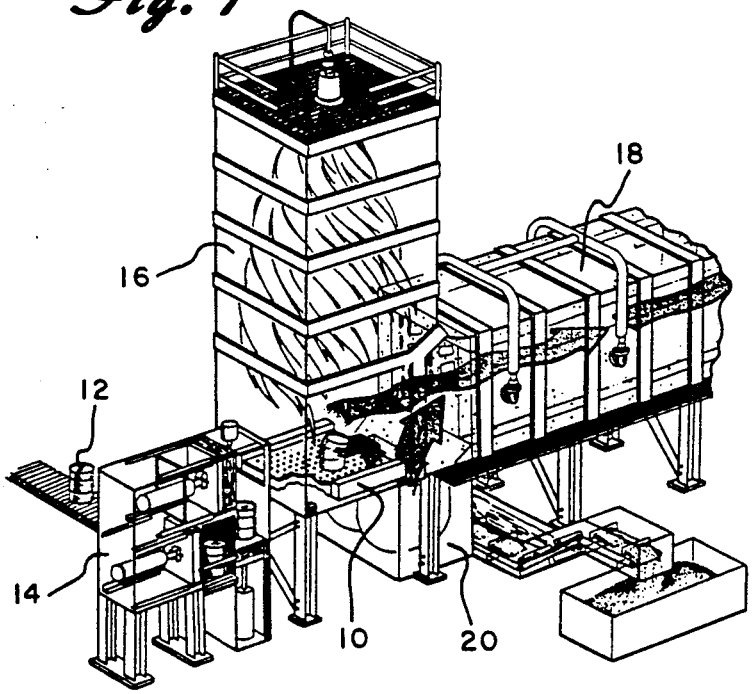
FIG. 1 is a schematic representation of a thermal processing system in which the hearth of the present invention may be utilized.

Referring now to the drawings in detail wherein like reference numerals have been used throughout the various figures to designate like elements, there is shown in FIG. 1 a thermal processing system or incinerator in which the improved hearth 10 (FIG. 2) of the present invention may be used. As shown in FIG. 1, barrels or other containers 12 which may include substantially any form of hazardous or non-hazardous waste material are fed from feed section 14 onto the surface of hearth 10 in the incineration section 16. Resultant gases, ash and other residue are treated in a known manner downstream of the hearth 10 in sections 18 and 20 of the system.

The general operation of the overall system shown in FIG. 1 is known in the art. Similarly, the various component parts (other than the improved hearth disclosed herein) are also well known. Accordingly, the details of these various components will not be specifically discussed. The system shown in FIG. 1 is generally disclosed primarily to show the preferred environment in which the hearth of the present invention may be used.

The hearth 10 of the present invention is shown in greater detail in FIGS. 2–6. The hearth is substantially horizontally disposed and includes an upper wall 22 and a lower wall 24 substantially parallel thereto but located beneath the upper wall so as to leave a space 26 therebetween. A plurality of ribs 27 (FIG. 5) or other structural members located between the upper and lower walls 22 and 24 provide rigidity to the hearth and also provide channels for directing water or other cooling liquids through the space 26.

Figure 2:
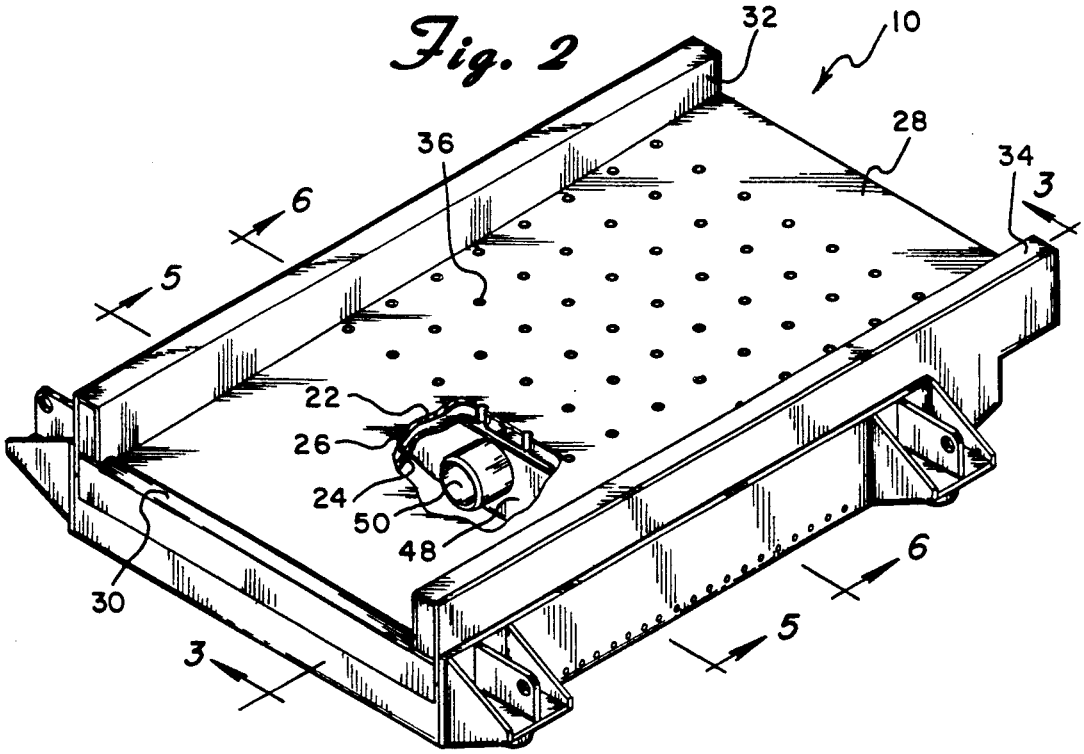
FIG. 2 is a perspective view, with a portion broken away, of a hearth constructed in accordance with the principles of the present invention.

Upper hearth wall 22 forms a grate which has a substantially flat or planar surface 28. The forward portion of the surface 28, i.e. that portion shown at the left of FIG. 2, is the feed end of the grate surface 28 and it is where materials to be treated are deposited. This forward end surface which is approximately one-third of the entire surface of the grate is substantially impervious. A dam in the form of an upstanding wall 30 extends across the entire width of the hearth and is located substantially at the very beginning of the forward feed end. Left and right side walls 32 and 34 extend upwardly from the remote side edges of the grate surface to prevent waste and incinerated materials from spilling off the sides.

Figure 3:
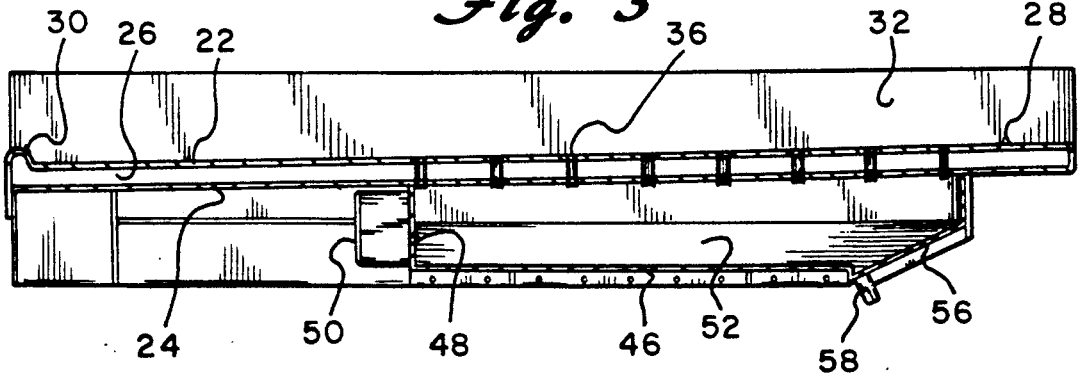
FIG. 3 is a cross-sectional view taken through the line 3—3 of FIG. 2.
Figure 4:
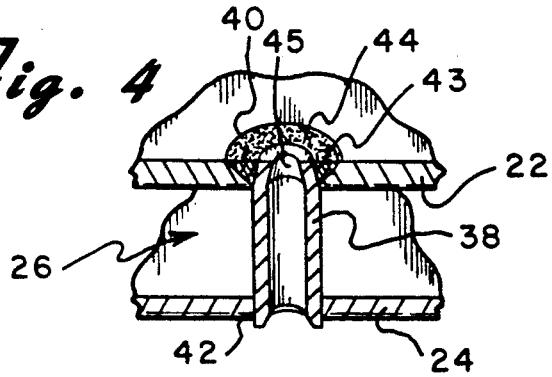
FIG. 4 is a partial cross-sectional view illustrating one of the air holes used with the hearth.
Figure 5:
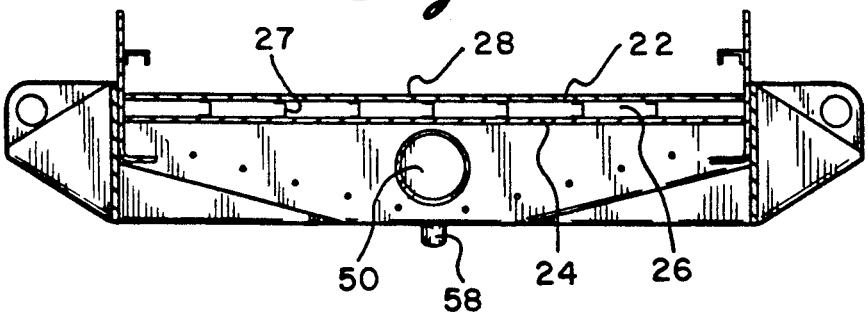
FIG. 5 is a cross-sectional view taken through the line 5—5 of FIG. 2.
Figure 6:
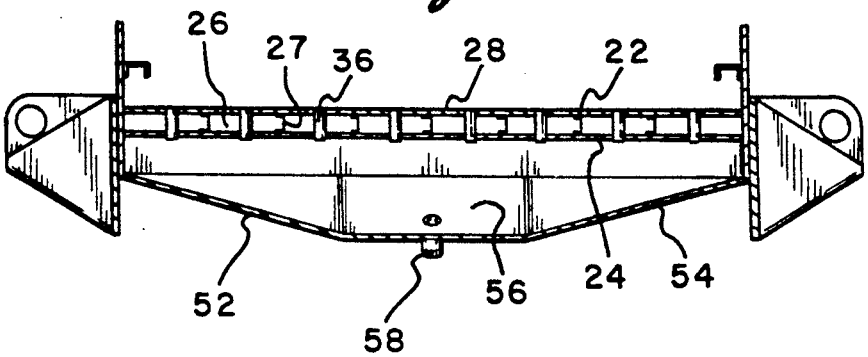
FIG. 6 is a cross-sectional view taken through the line 6—6 of FIG. 2.

As shown most clearly in FIG. 3, the walls 32 and 34 are slightly taller at the forward feed end of the hearth, i.e. at the left as shown in FIG. 3, than they are at the rearward or discharge end, i.e. at the right of FIG. 3. Thus, if the side walls are maintained in a substantially horizontal position, the upper grate surface 28 inclines upwardly at an angle of approximately 1.5 degrees.

The entire hearth assembly is mounted on springs or other resilient members (not shown) and is vibrated utilizing a vibrating system such as the drives used for vibrating screen feeders in rock crushing systems which are available from FMC Corporation. These feeders are commonly used in rock quarries and coal mines and the like for moving material along a path. Such vibrating system causes material on the hearth to be projected upwardly and forwardly and is capable of moving material up the inclined hearth from the forward feed end to the rearward discharge end.

The present invention utilizes an underfire air system for combustion. To accomplish this, the grate is provided with a plurality of air holes or openings such as shown at 36 through which air can be forced from beneath. As shown most clearly in FIGS. 3 and 4, the openings 36 are each comprised essentially of a small section of tube 38 that is secured at its top and bottom to a hole 40 formed in the top wall 22 of the hearth and a similar hole 42 formed in the bottom wall 24. The hole 40 in the top wall 22 is initially chamfered or flared outwardly such as shown at 43 in FIG. 4 so that a good weld 44 can be formed between the top of the tube 38 and the top wall 22. The opening 45 at the top of the tube 38 is preferably smaller in diameter than the inside of the rest of the tube thereby ensuring that any particle entering the tube from above will pass entirely therethrough. As a result of the foregoing arrangement and the use of the tubes 38 that are sealed at their tops and bottoms with respect to the upper and lower walls 22 and 24, air can pass upwardly through the openings without interfering with the cooling fluid being distributed through the space 26.

As shown in FIGS. 2 and 3, the openings or air holes 36 are located only in the actual combustion zone of the hearth. This zone is essentially everything but the forward feed end of the grate surface as explained above and comprises approximately two-thirds of the entire grate surface.

Located beneath the grate and extending substantially entirely under the area in which the air holes 36 are formed is a plenum 46. Plenum 46 has two primary functions. The first is to assist in supplying combustion air to each of the openings 36 and the second is to capture particles or ashes that fall downwardly through the openings.

Plenum 46 is comprised essentially of a forward vertical wall 48 which extends essentially across the entire width of the hearth and which includes an input duct or the like 50 at the forward end thereof which is adapted to be connected to a supply of air under pressure. The plenum 46 also includes left and right side bottom walls 52 and 54 (FIG. 6) which taper downwardly toward the middle of the plenum. Because of the taper of the walls 52 and 54, it should be readily apparent that any ashes falling through the openings 36 will tend to slide inwardly and accumulate near the centerline of the plenum.

The plenum is also provided with a rear wall 56 (FIG. 3) which tapers downwardly and inwardly from the far end of the plenum toward the center thereof. An output duct or pipe 58 or the like is located in this rear wall 56 adjacent the bottom thereof. The size of the opening in duct 58 is preferably larger than the size of any one of the air holes 36.

The hearth 10 is operated in the following manner. Hazardous or non-hazardous waste materials consisting of solids and/or liquids are placed onto the grate surface adjacent the forward feed end thereof. This can be done by either dumping the contents of containers onto the grate surface or by placing the entire container thereon such as shown in FIG. 1 whereby the container itself will also be incinerated.

Because of the manner in which the hearth is being vibrated as explained above, solid materials will be moved up the incline into the combustion zone. Liquid materials, however, will tend to run backwardly toward the forward feed end. However, as a result of the dam 30, such liquid materials will not flow off of the grate surface. Rather, this liquid will begin to accumulate on the grate surface adjacent the forward end thereof. Because of the temperatures that are involved, the liquid will evaporate before there is enough accumulation for the liquid to pass downwardly through any of the holes 36.

Combustion air under pressure passes through the conduit 50 into the interior of the plenum 46 and then upwardly through the plurality of holes 36. By controlling the amount and pressure of this air, the rate of cooling through the space 26 and the speed at which the hearth is vibrated, the materials passing across the combustion zone of the hearth can be properly incinerated or otherwise processed.

Ash from the incinerated materials will occasionally pass downwardly through the openings 36 and such ash is assisted in doing so as a result of the tapered openings 44 as explained above. This ash will fall into the interior of the plenum 46. However, as a result of the tapered bottom walls 52 and 54, the tapered rear wall 56 and the manner in which the hearth is vibrated, the ash tends to accumulate at the middle and rear end of the plenum. That is, the tapered bottom walls 52 and 54 move the ash inwardly and the motion of the hearth moves the ash rearwardly in substantially the same manner that the materials being treated on the grate are moved across the surface of the same. The ash is continuously removed from the plenum through the opening 58. The air being forced into the plenum through the duct 50 forces the ash through the output duct or pipe 58 into an appropriate receptacle. This occurs while the hearth is operating. It is noted that the bulk of the ash produced does not pass through the openings 36 but traverses the hearth surface 28 and falls off the end thereof into an appropriate receptacle.

The present invention may be embodied in other specific forms without departing from the spirit or essential attributes thereof and accordingly reference should be made to the appended claims rather than to the foregoing specification as indicating the scope of the invention.

I claim:

1. In a vibratory hearth having a substantially planar upper surface and a plurality of openings therein for passing combustion air upwardly therethrough from beneath said surface, the improvement comprising an ash bin located beneath said openings for catching ashes that fall downwardly through the same, said ash bin being in the form of a substantially closed plenum having an input at one end adapted to be connected to an air supply source and an output adjacent the other end thereof for removing the ash within said ash bin; said openings having tops and bottoms which are smaller in diameter at the tops than at the bottoms.

2. The invention as claimed in claim 1 wherein said plenum has a bottom wall that tapers downwardly from the sides of the plenum toward the center thereof so that ash will accumulate adjacent the bottom center of the ash bin.

3. The invention as claimed in claim 3 wherein said plenum includes a rear wall that tapers downwardly from said other end to said bottom wall, said output being located in said rear wall.

4. The invention as claimed in claim 1 wherein said ash bin is secured to said hearth so as to vibrate therewith.

5. In a vibrating hearth including a grate surface having a forward feed end onto which materials to be treated are deposited, a rearward discharge end, a plurality of air holes passing through the surface of said grate, means for supplying combustion air upwardly through said air holes and means for vibrating said hearth in such a manner that the deposited materials are moved from the forward end to the rearward end, the improvement comprising means mounting said hearth so that said grate is inclined upwardly from said forward end to said rearward end and including a dam comprised of a wall extending upwardly from the surface of said grate adjacent said forward end, said dam extending entirely across the width of said grate.

6. The invention as claimed in claim 5 wherein the surface of said grate is substantially planar.

7. The invention as claimed in claim 5 wherein said air holes are located only in an area of said grate downstream from said forward end, the area of said grate surface adjacent said forward end being substantially imperforate.

8. The invention as claimed in claim 5 further including an ash bin located beneath said air holes for catching ashes that fall downwardly through the same.

9. The invention as claimed in claim 8 wherein said ash bin is in the form of a substantially closed plenum having an input at one end adapted to be connected to an air supply source and an output adjacent the other end thereof for removing the ash therefrom.

10. The invention as claimed in claim 9 wherein said plenum has a bottom wall that tapers downwardly from the sides of the plenum toward the center thereof so that ash will accumulate adjacent the bottom center of the ash bin.

11. The invention as claimed in claim 10 wherein said plenum includes a rear wall that tapers downwardly from said other end to said bottom wall, said output being located in said rear wall.

12. The invention as claimed in claim 5 wherein said air holes have tops and bottoms and are smaller in diameter at the tops thereof than at the bottoms.

13. The invention as claimed in claim 8 wherein said ash bin is secured to said hearth so as to vibrate therewith.

* * * * *